US011867047B2

(12) United States Patent
Han et al.

(10) Patent No.: US 11,867,047 B2
(45) Date of Patent: Jan. 9, 2024

(54) WORKFLOW TO EVALUATE THE TIME-DEPENDENT PROPPANT EMBEDMENT INDUCED BY FRACTURING FLUID PENETRATION

(71) Applicant: ARAMCO SERVICES COMPANY, Houston, TX (US)

(72) Inventors: Yanhui Han, Houston, TX (US); Feng Liang, Cypress, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/806,030

(22) Filed: Jun. 8, 2022

(65) Prior Publication Data

US 2023/0399932 A1 Dec. 14, 2023

(51) Int. Cl.

| | |
|---|---|
| ***E21B 43/267*** | (2006.01) |
| ***E21B 49/00*** | (2006.01) |
| ***E21B 49/08*** | (2006.01) |

(52) U.S. Cl.

CPC ..... *E21B 43/267* (2013.01); *E21B 49/006* (2013.01); *E21B 49/008* (2013.01); *E21B 49/087* (2013.01); *E21B 2200/20* (2020.05)

(58) Field of Classification Search

CPC ..... E21B 43/267; E21B 43/26; E21B 49/00; E21B 43/17; E21B 41/00; E21B 41/0035;

(Continued)

(56) References Cited

U.S. PATENT DOCUMENTS

| | | | |
|---|---|---|---|
| 9,677,393 | B2 | 6/2017 | Morris |
| 10,001,769 | B2 | 6/2018 | Huang et al. |

(Continued)

OTHER PUBLICATIONS

M. Fan et al.; "Experimental and Numerical Investigations of the Role of Proppant Embedment on Fracture Conductivity in Narrow Fractures", SPE-204222-PA; Society of Petroleum Engineers; Feb. 2021; pp. 324-342 (19 pages).

(Continued)

*Primary Examiner* — Zakiya W Bates

(74) *Attorney, Agent, or Firm* — Osha Bergman Watanabe & Burton LLP

(57) ABSTRACT

A method is used to determine the permeability of a hydraulic fracture. The method includes obtaining formation parameters and a plurality of formation samples, dividing the plurality of formation samples into a first group and a second group, measuring mechanical and hydraulic properties of the first group, soaking the second group in a fracturing fluid for a plurality of time periods, and measuring, after each soaking time period, the mechanical and hydraulic properties of the second group. The soaking the second group in the fracturing fluid includes soaking the second group in a plurality of different fracturing fluids. The method further includes building, using a computer processor, a proppant-rock interaction model based, at least in part, on the mechanical and hydraulic properties of the first group and the second group, and determining, using the computer processor, the permeability of a hydraulic fracture based, at least in part, on the proppant-rock interaction model and the formation parameters.

9 Claims, 6 Drawing Sheets

(58) Field of Classification Search
CPC .... E21B 2200/20; E21B 47/002; E21B 43/16; E21B 49/02
See application file for complete search history.

(56) References Cited

U.S. PATENT DOCUMENTS

| | | | | |
|---|---|---|---|---|
| 2020/0056460 | A1 | 2/2020 | Isaev et al. | |
| 2021/0041597 | A1* | 2/2021 | Hongjun | G01V 99/005 |
| 2021/0324719 | A1* | 10/2021 | Jin | G01N 15/0826 |

OTHER PUBLICATIONS

Y. Han et al.; "Numerical Modeling of Elastic Spherical Contact for Mohr-Coulomb Type Failures in Micro- Geomaterials", Experimental Mechanics; vol. 57; Jun. 16, 2017; pp. 1091-1105 (15 pages).

Y. Han and F. Liang; "Performance evaluation of SDAGM-coated microproppants in hydraulic fracturing using the lattice Boltzmann method", The Canadian Journal of Chemical Engineering; Apr. 20, 2021; pp. 1-12 (12 pages).

B. Lai et al.; "Fracturing Fluids Effects on Mechanical Properties of Organic Rich Shale", ARMA 16-180; American Rock Mechanics Association; Jun. 26, 2016; pp. 1-10 (10 pages).

A. Reinicke et al.; "Mechanical and Hydraulic Aspects of Rock-Proppant Systems: Experimental Approaches and Implications for Reservoir Treatments", Proceedings World Geothermal Congress 2010, Bali, Indonesia; Apr. 2010; pp. 1-9 (9 pages).

Y. Tang and P. G. Ranjith; "An experimental and analytical study of the effects of shear displacement, fluid type, joint roughness, shear strength, friction angle and dilation angle on proppant embedment development in tight gas sandstone reservoirs", International Journal of Rock Mechanics and Mining Sciences; vol. 106; Mar. 18, 2018; pp. 94-109 (16 pages).

* cited by examiner

WORKFLOW TO EVALUATE THE TIME-DEPENDENT PROPPANT EMBEDMENT INDUCED BY FRACTURING FLUID PENETRATION

BACKGROUND

Horizontal drilling and multistage hydraulic fracturing are two key technologies that make it economical to produce oil and gas from unconventional reservoirs. Because the horizontal extent of most reservoir formation layers is much greater than their thickness, a long horizontal well created by horizontal drilling has much larger contact area with the reservoir formation than a vertical well. Multiple fractures created by multistage hydraulic fracturing will further increase the contact area with the reservoir formation. After the hydraulic fracturing operation is completed, the fluid pressure in the well and hydraulic fractures must be reduced to a value lower than the formation pore pressure so that the oil and gas can flow into to the hydraulic fractures which serve as fluid flow pathways to the well. However, the reduction of fluid pressure inside the hydraulic fracture after hydraulic fracturing will cause the hydraulic fractures to close. To maintain the opening of the hydraulic fractures, proppant particles, such as sand of various sizes, are injected with fracturing fluid into the hydraulic fractures during hydraulic fracturing process. In this way, proppants may take part of the load imposed by the in-situ stress (and the other part of in-situ stress will be balanced by the residual fluid pressure in the hydraulic fracture) so the closing of hydraulic fractures can be prevented.

The load imposed by the in-situ stress on the proppants may be transferred to the reservoir formation surfaces that are in contact with proppants. To generate a reaction force that is equivalent to this load, the reservoir formation will deform at the location in contact with proppant particles. The magnitude of resulted deformation and the embedment of proppant particles into the formation will depend on the magnitude of the applied load, the stiffness and strength of the formation and the geometrical and mechanical properties of proppants. When deformation happens, the aperture of the stimulated hydraulic fracture may gradually decrease during production. Therefore, it is important to predict the proppant embedment at the various stress levels that proppants are expected to experience during production.

In practice, the proppant embedment is usually measured by laboratory testing in which by a proppant layer is compressed when it is sandwiched by two formation rock samples. Alternatively, proppant embedment may also be predicted by theoretical analysis then calibrated with lab or field data. However, current methods of estimated proppant embedment neglect to consider the weakening and softening of formation rock in response to exposure to fracturing fluids.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method of determining a permeability of a hydraulic fracture. The method may include obtaining formation parameters and a plurality of formation samples and dividing the plurality of formation samples into a first group and a second group. The method may also include measuring mechanical and hydraulic properties of the first group, soaking the second group in a fracturing fluid for a plurality of time periods, and measuring, after each soaking time period, the mechanical and hydraulic properties of the second group. The method may further include building, using a computer processor, a proppant-rock interaction model based, at least in part, on the mechanical and hydraulic properties of the first group and the second group, and determining, using the computer processor, the permeability of a hydraulic fracture based, at least in part, on the proppant-rock interaction model and the formation parameters.

In another aspect, embodiments disclosed herein relate to a non-transitory computer readable medium storing instructions executable by a computer processor. The instructions may include functionality for receiving formation parameters, receiving mechanical and hydraulic properties for a first group of formation samples, and receiving mechanical and hydraulic properties for a second group of formation samples, wherein the mechanical and hydraulic properties are determined after soaking the second group in a fracturing fluid for a plurality of time periods. The instructions may also include functionality for building a proppant-rock interaction model based, at least in part, on the mechanical and hydraulic properties of the first group and the second group, and determining a permeability of a hydraulic fracture based, at least in part, on the proppant-rock interaction model and the formation parameters.

In yet another aspect, embodiments disclosed herein relate to a system, which may include a rock sample analyzer. The rock sample analyzer may be configured to obtain formation parameters, measure mechanical and hydraulic properties of a first group of formation samples, soak a second group of formation samples in a fracturing fluid for a plurality of time periods, and measure the mechanical and hydraulic properties of the second group of formation samples. The system may also include a computer processor, configured to build a proppant-rock interaction model based, at least in part, on the mechanical and hydraulic properties of the first group and the second group, and determine a permeability of a hydraulic fracture based, at least in part, on the proppant-rock interaction model and the formation parameters.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
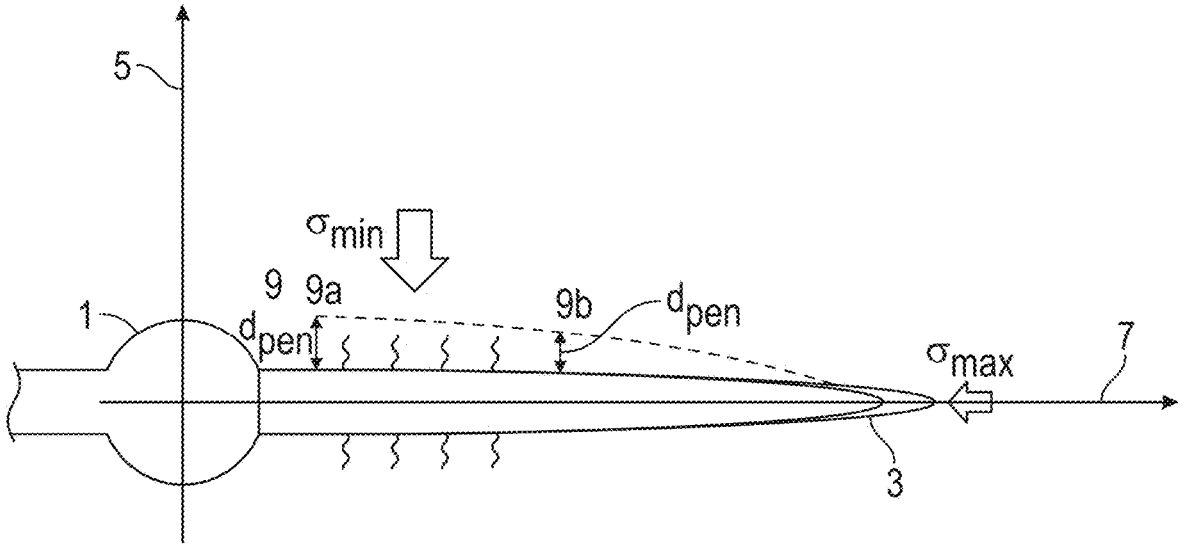
FIG. 1 shows a schematic of fluid embedment within a formation in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-8, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a seismic data set" includes reference to one or more of such seismic data set.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

Disclosed herein are embodiments of systems and methods for determining time-dependent proppant embedment within a formation rock sample induced by fracturing fluid penetration. More specifically, disclosed herein are embodiments of a workflow wherein samples of formation rock are soaked in a fracturing fluid for a given period of time, and their resulting mechanical properties are inputted into a model along with those of unsoaked formation rock samples in order to predict proppant embedment within the formation rock.

When fracturing fluid is injected into a formation, fracturing fluid may penetrate into the formation during hydraulic fracturing operations, which may be referred to as 'leak-off'. One skilled in the art will be aware that fracturing fluids may be aqueous fluids which include a variety of chemical additives and proppant particles. In one or more embodiments, the proppant particles may be sand particles. However, there are many examples of proppant particles suitable for the systems and methods disclosed herein, and any such proppant particle may be used without departing from the scope of this disclosure.

FIG. 1 depicts a hydraulic fracture 3 extending from a well 1 into a formation. In one or more embodiments, the hydraulic fracture 3 may be considered to extend along a first axis 7. Furthermore, a penetration depth $d_{Pen}$ may be measured along a second axis 5 orthogonal to the first axis. Hereinafter, it will be convenient to refer to the first axis as the "horizontal" axis and the second axis as the "vertical" axis, although these axes may have an arbitrary orientation with respect to the local gravitational gradient direction.

The penetration depth 9 of the proppant particles may depend on the permeability and porosity of the formation, the viscosity of the fracturing fluid, and the time the formation was exposed to the fracturing fluid. Fracturing fluid penetration depth may be defined as:

$$d_{Pen}(x,t)=\sqrt{c(t-\tau(x))}, \quad \text{(Equation 1)}$$

where $d_{Pen}$, is the fracturing fluid penetration depth 9 at location x at time t, x is the distance of the location of interest from the hydraulic fracture entrance, t is the start time of hydraulic fracturing, $\tau$ is the time at which fracturing fluid reaches location x, and c is the diffusion coefficient, which may be defined as:

$$c = \frac{\kappa}{\mu\phi C_f}, \quad \text{(Equation 2)}$$

where $\kappa$ is the intrinsic permeability of the formation, $\phi$ is the porosity of the formation, $\mu$ is the viscosity of the fracturing fluid, and $C_f$ is the compressibility of the fracturing fluid. Applying Equation 1, the penetration depth of the fracturing fluid 9 decreases as the distance from the well 1 increases. This is visually represented on FIG. 1 by the penetration depths of fracturing fluid 9 at locations 9*a* and 9*b*.

Figure 2:
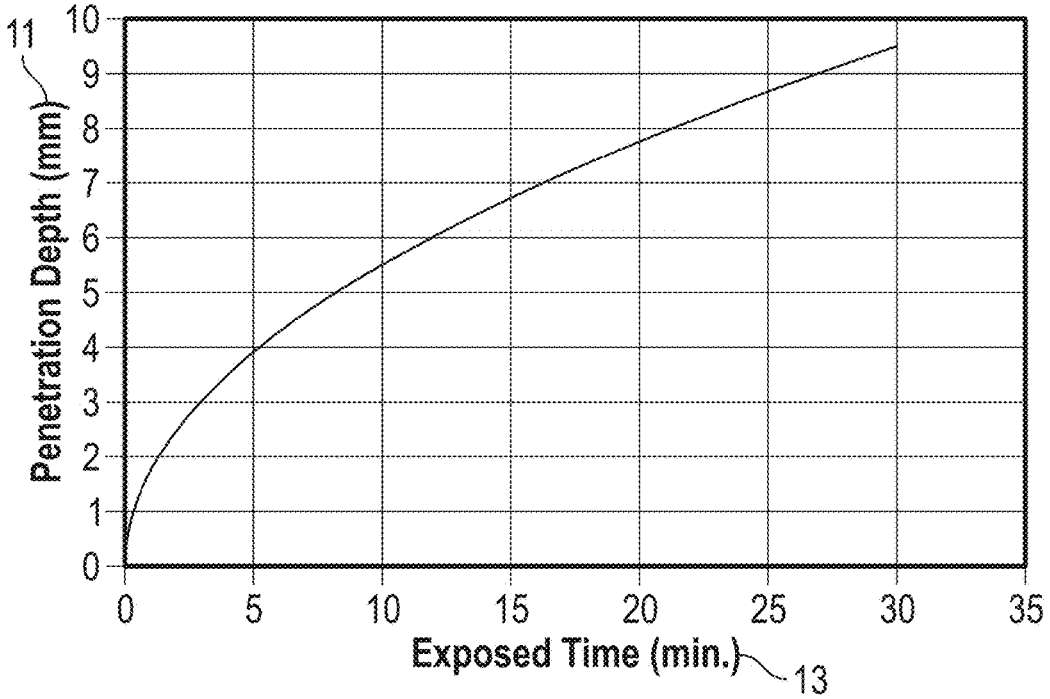
FIG. 2 shows a graph of fluid penetration depth variation with time after proppant placement in accordance with one or more embodiments.

FIG. 2 depicts a graphical representation of the relationship between fracturing fluid penetration depth, indicated on the vertical axis 11, and time the formation was exposed to the fracturing fluid, indicated on the horizontal axis 13. More specifically, FIG. 1 depicts a graphical representation of Equation 1. As can be seen, an increase in exposure time leads to an increase in fracturing fluid penetration depth. Fracturing fluid penetration depth may be measured perpendicular to the principal plane of the hydraulic fracture. One skilled in the art will be aware that exposing formation rocks, particularly those that are organic-rich, to aqueous fracturing fluids can cause rock softening and weakening. Softening and weakening of formation rocks correlates to a reduction of Young's modulus, compressive strength, and tensile strength of the formation rock. Therefore, FIG. 2 indicates that greater exposure time to fracturing fluids is expected to lead to softening and weakening of formation rocks.

Figure 3C:
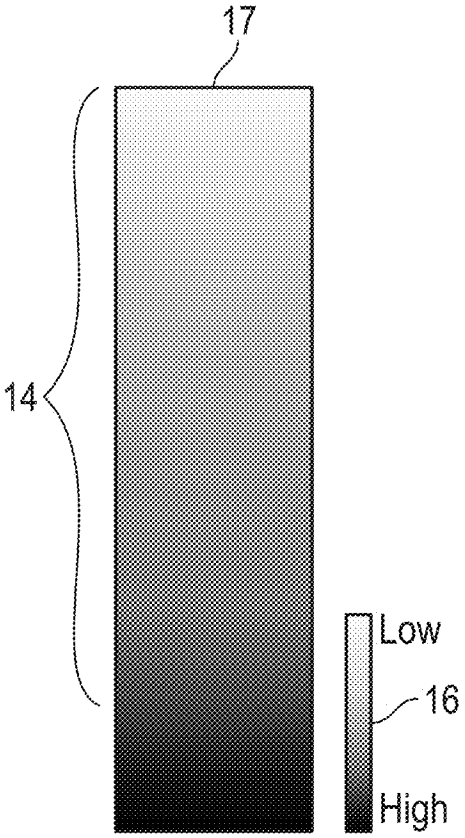
FIGS. 3A-3C show schematics of formation rock sample tensile strengths after various time periods of fracturing fluid exposure in accordance with one or more embodiments.
Figure 3B:
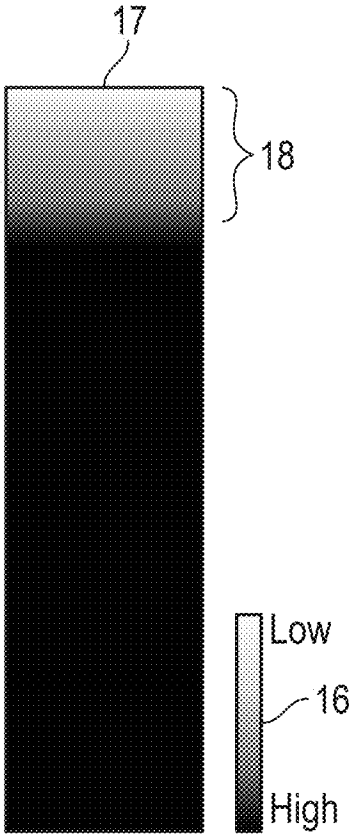
Figure 3A:
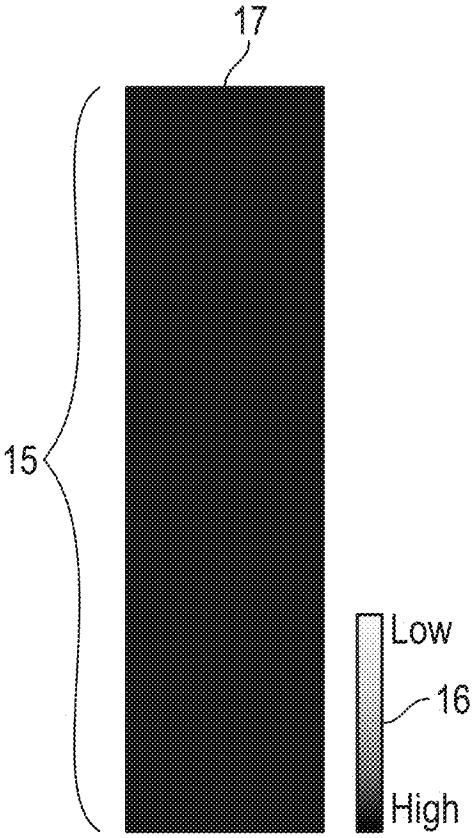

Softening and weakening of formation rocks may affect a number of material properties of the formation rocks. This may include tensile strength of the formation rocks. FIGS. 3A-3C depicts the effects on formation tensile strength as a result of different exposure times to fracturing fluid. In FIGS. 3A-3C, tensile strength is depicted by a grayscale scale 16, where the darkest gray represents the original, "full" tensile strength of the formation samples, and the lighter grays depicts weakening tensile strength. FIGS. 3A-3C all include a formation sample with a height 15. In one or more embodiments, the height 15 may be 2 mm. In particular, FIG. 3A depicts a formation sample which has not been exposed to fracturing fluid. As can be seen, the tensile strength of the sample is uniform throughout the height 15 of the sample.

FIG. 3B shows the tensile strength of the formation sample after a 15 second exposure to fracturing fluid over the upper surface 17 of the sample. FIG. 3B shows that the tensile strength of the formation rock sample has been reduced across a small region 18 of the formation sample, such that a majority of the sample maintains the original tensile strength.

FIG. 3C shows the tensile strength of the formation rock sample after an 8.5 minute exposure to fracturing fluid. In contrast to FIG. 3B, it can be seen that a longer exposure time leads to a deeper penetration of the perturbed zone 14 into the sample. Therefore, variances in tensile strength stretch through almost the entire height 15 of the sample, as a result of the deeper penetration.

During hydraulic fracturing operations, proppant particles may layer within hydraulic fractures in the formation. In one or more embodiments, proppant particles may form a monolayered particle pack. In other embodiments, proppant particles may form multiple layered particle packs.

Figure 4:
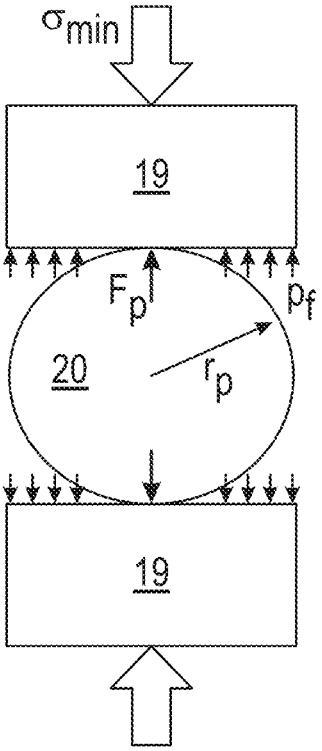
FIG. 4 shows a schematic of proppant particle loading conditions in accordance with one or more embodiments.

After hydraulic fracturing operations, the fluid pressure inside the hydraulic fracture may be relieved, with in-situ stresses being absorbed by both the "residual" fluid pressure inside the fracture, which is present throughout production, and by proppant particles 20. FIG. 4 depicts a schematic of the loading conditions of a proppant particle 20 after hydraulic fracturing pressure has been removed. The force acting on a proppant particle 20 may be defined as:

$$F_p=\pi r_p^2(\sigma_{min}-p_f), \quad \text{(Equation 3)}$$

where $r_p$ is the radius of the proppant particle 2, $\sigma_{min}$ is the minimum principal in-situ stress that acts normal to the hydraulic fracture, $p_f$ is the fluid pressure inside the hydraulic fracture and $F_p$ is the force acting on the proppant particle 20.

In one or more embodiments, the formation 19 may behave like an isotropic, homogenous, linear elastic material. In such embodiments, proppant particle 20 embedment into the formation 19 may be solved from the Hertz contact formula:

$$F_p=\frac{4}{3}E^* r_p^{\frac{1}{2}}\delta^{\frac{1}{2}}, \quad \text{(Equation 4)}$$

where δ is the displacement of the proppant particle 20 center under the load of $F_p$ and E* is an intermediate variable determined by the stiffness parameters of the proppant particle 20 and the formation 19. In embodiments where the proppant particle 20 is much stiffer than the formation 19, the proppant particle 20 embedment may be equivalent to δ. E* may be defined as:

$$\frac{1}{E^*}=\frac{1-v_r^2}{E_r}+\frac{1-v_p^2}{E_p}, \quad \text{(Equation 5)}$$

where $E_r$ is the Young's modulus of the formation 19, $v_r$ is the Poisson's ratio of the formation 19, $E_p$ is the Young's modulus of the proppant particle 20, and $v_p$ is the Poisson's ratio of the proppant particle 20.

When loaded by proppant particles 20, formations 19 may demonstrate elastoplastic behaviors. One skilled in the art will be aware that, as a result of such behaviors, part of the embedment may not recover after the load exerted by the proppant particle 20 is completely relieved. As a result of having both elastic and plastic deformation components, proppant particle 20 embedment may not be evaluated analytically. Rather, proppant particle 20 embedment must be calculated through numerical simulation. The softening and weakening effects of fracturing fluids on formations 19 may also be incorporated into such numerical simulations.

Figure 5A:
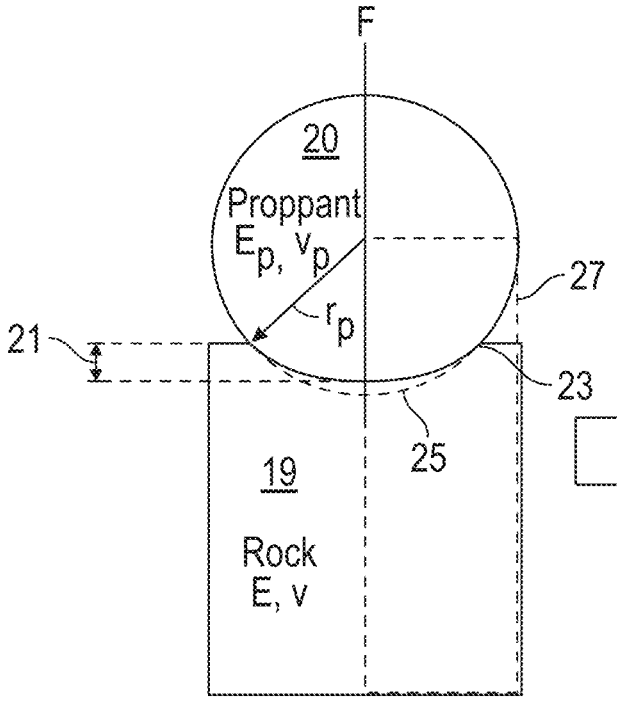
FIGS. 5A-5B show a proppant-rock interaction model in accordance with one or more embodiments.
Figure 5B:
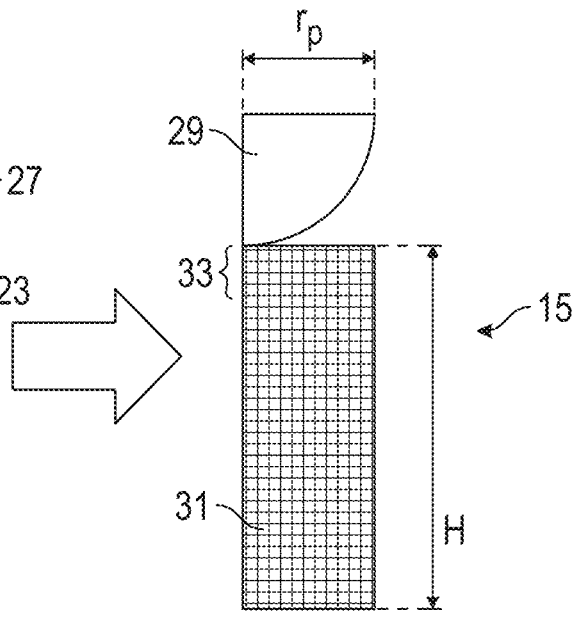

FIGS. 5A and 5B depict a proppant-rock interaction model in accordance with one or more embodiments. FIG. 5A shows a schematic of a proppant particle 20 which has an embedment 21 into a formation 19. In one or more embodiments, the proppant particle 20 may deform from its original dimension 23 to a deformed dimension 25. An axisymmetric model may be developed by selecting a specific region 27 to be the focus of the model. A roller boundary condition may be applied to the bottom boundary and right boundary of the model to prevent movement in the direction normal to the boundary.

FIG. 5B shows an axisymmetric mesh model in accordance with one or more embodiments. After an initial mesh is generated, material properties may be assigned to various regions within the mesh. For example, proppant particle 20 material properties may be assigned to the top quarter cylindrical region 29. Material properties of the formation 19 may be assigned to the bottom rectangular region 31. The bottom rectangular region 31 may be discretized on a grid. In some embodiments, the grid may be a cartesian grid. However, in other embodiments the grid may be a cylindrical grid. Modified material properties of the formation 19, consistent with the example presented in FIGS. 3A-3C, of softening and weakening of the formation 19 due to fracturing fluid exposure, may be applied to a region 33 representing fracturing fluid penetration depth. In one or more embodiments, the simulation may be symmetrical around the axis of the proppant particle 20.

The simulation may be driven by a pressure load exerted on the proppant particle 20. A proppant particle 20 may have a minimum stress, otherwise known as in-situ stress acting normal to the hydraulic fracture. The proppant particle 2 may further be subjected to a pressure which acts in the hydraulic fracture during production, which may be defined as the difference between the formation 1 pressure and drawdown. In developing the simulation, the loading pressure exerted on the proppant particle 2 may be increased from zero to a value equal to the difference between the minimum principal stress and the pressure in the hydraulic fracture during production. Proppant particle embedment may then be predicted using the simulation model. In such a model, hydraulic fracture conductivity will be affected by the proppant particle embedment. Increases in proppant embedment will also cause a reduction in the hydraulic fracture aperture. The proppant pack within a hydraulic fracture may be considered a porous medium, the porosity of which may decrease with time, causing a decrease in hydraulic fracture permeability and conductivity.

Figure 6:
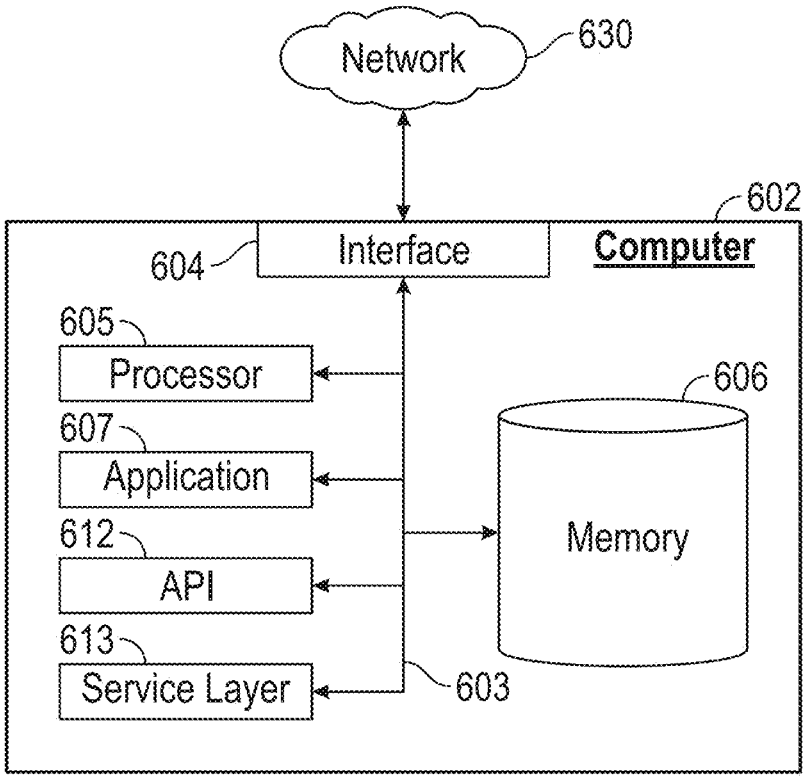
FIG. 6 depicts a computer system in accordance with one or more embodiments.

The proppant-rock model is a mathematical model based on the Hertz contact formula. In one or more embodiments, the mathematical model may require a computer determine the deformation of the formation and the embedment and deformation of the proppant. FIG. 6 depicts a block diagram of a computer system 602 used to provide computational functionalities associated with described algorithms, methods, functions, processes, flows, and procedures as described in this disclosure, according to one or more embodiments. The illustrated computer 602 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 602 may include a computer that includes an input device, such as a keypad, keyboard, touch screen, or other device that can accept user information, and an output device that conveys information associated with the operation of the computer 602, including digital data, visual, or audio information (or a combination of information), or a GUI.

The computer 602 can serve in a role as a client, network component, a server, a database or other persistency, or any other component (or a combination of roles) of a computer system for performing the subject matter described in the instant disclosure. The illustrated computer 602 is communicably coupled with a network 630. In some implementations, one or more components of the computer 602 may be configured to operate within environments, including cloud-computing-based, local, global, or other environment (or a combination of environments).

At a high level, the computer 602 is an electronic computing device operable to receive, transmit, process, store, or manage data and information associated with the described subject matter. According to some implementations, the computer 602 may also include or be communicably coupled with an application server, e-mail server, web server, caching server, streaming data server, business intelligence (BI) server, or other server (or a combination of servers).

The computer 602 can receive requests over network 630 from a client application (for example, executing on another computer 602) and responding to the received requests by processing the said requests in an appropriate software application. In addition, requests may also be sent to the computer 602 from internal users (for example, from a command console or by other appropriate access method), external or third-parties, other automated applications, as well as any other appropriate entities, individuals, systems, or computers.

Each of the components of the computer 602 can communicate using a system bus 603. In some implementations, any or all of the components of the computer 602, both hardware or software (or a combination of hardware and software), may interface with each other or the interface 604 (or a combination of both) over the system bus 603 using an application programming interface (API) 612 or a service layer 613 (or a combination of the API 612 and service layer 613. The API 612 may include specifications for routines, data structures, and object classes. The API 612 may be either computer-language independent or dependent and refer to a complete interface, a single function, or even a set of APIs. The service layer 613 provides software services to the computer 602 or other components (whether or not illustrated) that are communicably coupled to the computer 602. The functionality of the computer 602 may be accessible for all service consumers using this service layer. Software services, such as those provided by the service layer 613, provide reusable, defined business functionalities through a defined interface. For example, the interface may be software written in JAVA, C++, or other suitable language providing data in extensible markup language (XML) format or another suitable format. While illustrated as an integrated component of the computer 602, alternative implementations may illustrate the API 612 or the service layer 613 as stand-alone components in relation to other components of the computer 602 or other components (whether or not illustrated) that are communicably coupled to the computer 602. Moreover, any or all parts of the API 612 or the service layer 613 may be implemented as child or sub-modules of another software module, enterprise application, or hardware module without departing from the scope of this disclosure.

The computer 602 includes an interface 604. Although illustrated as a single interface 604 in FIG. 6, two or more interfaces 604 may be used according to particular needs, desires, or particular implementations of the computer 602. The interface 604 is used by the computer 602 for communicating with other systems in a distributed environment that are connected to the network 630. Generally, the interface 604 includes logic encoded in software or hardware (or a combination of software and hardware) and operable to communicate with the network 630. More specifically, the interface 604 may include software supporting one or more communication protocols associated with communications such that the network 630 or interface's hardware is operable to communicate physical signals within and outside of the illustrated computer 602.

The computer 602 includes at least one computer processor 605. Although illustrated as a single computer processor 605 in FIG. 6, two or more processors may be used according to particular needs, desires, or particular implementations of the computer 602. Generally, the computer processor 605 executes instructions and manipulates data to perform the operations of the computer 602 and any machine learning networks, algorithms, methods, functions, processes, flows, and procedures as described in the instant disclosure.

The computer 602 also includes a memory 606 that holds data for the computer 602 or other components (or a combination of both) that can be connected to the network 630. For example, memory 606 can be a database storing data consistent with this disclosure. Although illustrated as a single memory 606 in FIG. 6, two or more memories may be used according to particular needs, desires, or particular implementations of the computer 602 and the described functionality. While memory 606 is illustrated as an integral component of the computer 602, in alternative implementations, memory 606 can be external to the computer 602.

The application 607 is an algorithmic software engine providing functionality according to particular needs, desires, or particular implementations of the computer 602, particularly with respect to functionality described in this disclosure. For example, application 607 can serve as one or more components, modules, applications, etc. Further, although illustrated as a single application 607, the application 607 may be implemented as multiple applications 607 on the computer 702. In addition, although illustrated as integral to the computer 602, in alternative implementations, the application 607 can be external to the computer 602.

There may be any number of computers 602 associated with, or external to, a computer system containing a computer 602, wherein each computer 602 communicates over network 630. Further, the term "client," "user," and other appropriate terminology may be used interchangeably as appropriate without departing from the scope of this disclosure. Moreover, this disclosure contemplates that many users may use one computer 602, or that one user may use multiple computers 602.

Figure 7:
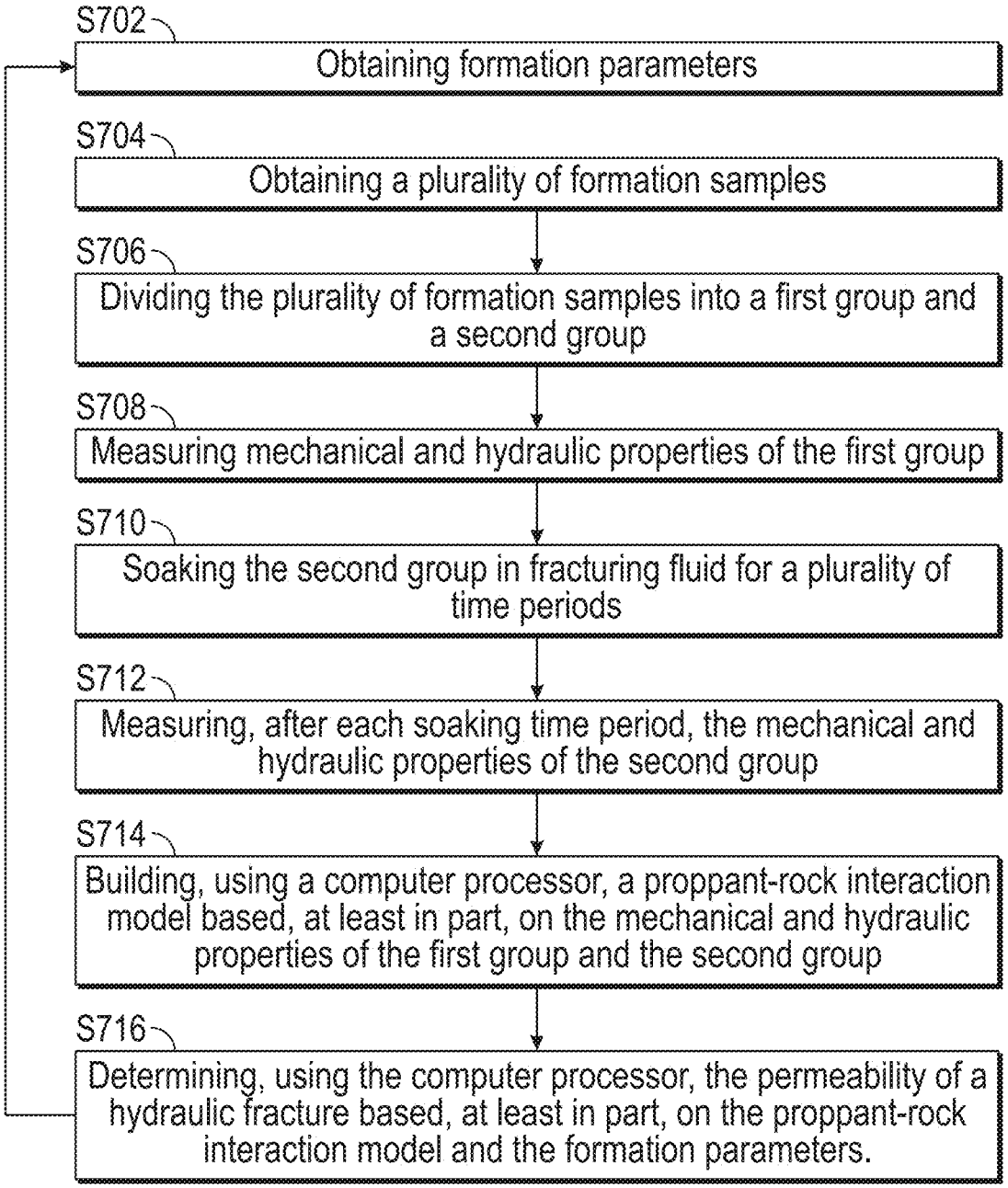
FIG. 7 is a flowchart of a method in accordance with one or more embodiments.

FIG. 7 depicts a flowchart in accordance with one or more embodiments. More specifically, FIG. 7 depicts a flowchart 700 of a method of developing a simulation for determining proppant particle embedment within a formation sample 1. Further, one or more blocks in FIG. 7 may be performed by one or more components as described in FIGS. 1-6. While the various blocks in FIG. 7 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, in step S702, formation 1 parameters may be obtained. In one or more embodiments, formation 1 parameters may include in-situ stresses, pore pressure, vertical stress, maximum and minimum horizontal stresses, and drawdown. In one or more embodiments, the formation 1 may be a shale formation. However, there are other embodiments where the formation 1 may be another water sensitive formation where mechanical and hydraulic properties may be affected by aqueous-based fracturing fluids.

In step S704, formation samples 1 may be obtained. The formation samples 1 may then be divided into a first group and a second group in step S706. Step S708 involves measuring the mechanical and hydraulic properties of the first group of formation samples 1. In one or more embodiments, the mechanical and hydraulic properties may include Young's modulus, Poisson's ratio, uniaxial compressive strength, friction angle, porosity, and permeability. In one or more embodiments, the mechanical and hydraulic properties may also be referred to as material properties.

In step S710, the second group of formation samples 1 may be soaked in a fracturing fluid for a plurality of time periods. The fracturing fluid may be a predominantly aqueous fluid which includes a variety of chemical additives and proppant particles 2. The soaking conditions performed in the method may match the soaking conditions present in field hydraulic fracturing operations, that may vary between a few hours and a few days. In one or more embodiments, the soaking time could be further extended, if the method is configured to consider well shut-in time. As a result, step S710 may vary in duration depending on the intended field conditions. In one or more embodiments, for example, step S710 may have a duration anywhere in the range of a few days to a month. In such situations, proppant particle embedment may continue if the drawdown reduces as time goes on. One skilled in the art will be aware that drawdown refers to the pressure difference between the wellbore and the formation during production.

In step S712, the mechanical and hydraulic properties of the second group of formation samples 1 may be measured after each soaking time period. The mechanical and hydraulic properties may be the same as those measured in step S708. In one or more embodiments, steps S702 to S712 may be performed in a rock sample analyzer.

Step S714 includes building, using a computer processor, a proppant-rock interaction model based, at least in part, on the measured mechanical and hydraulic properties of the first and second groups of formation samples 1. The proppant-rock interaction model may also be referred to as a contact simulator. The proppant-rock interaction model may be developed by assigning the material properties of the first group of formation samples 1 to regions of the model farther than fluid penetration depth, and by assigning the material properties of the proppant to the region representing proppant in the model. The material properties of the second group may then be scaled according to a ratio of exposed time at the specific location within the model to the time required for full softening and weakening of the formation samples 1. Therefore, scaled material properties can be applied across the region of the model which represents the fracturing fluid penetration depth within the formation samples 1. For example, the sample surface in contact with the proppant particle 20 may be assigned material properties of the formation samples 1 with the largest exposure time, and the surface at the maximum fracturing fluid penetration depth may be assigned scaled material properties measured after minimal exposure time. The surfaces between the sample surface and the surface at maximum fracturing fluid penetration depth are assigned material properties which vary either linearly or nonlinearly based on the above discussed ratio.

Step S716 completes the method and involves determining, using the computer processor, the permeability of a hydraulic fracture based, at least in part, on the proppant-rock interaction model and the formation parameters obtained in S702. The proppant-rock interaction model may be used to develop a hydraulic fracturing plan that maximizes hydraulic fracture conductivity, which, in turn, implies maximization of hydrocarbon production. The hydraulic fracturing plan may then be implemented in field hydraulic fracturing operations.

Figure 8:
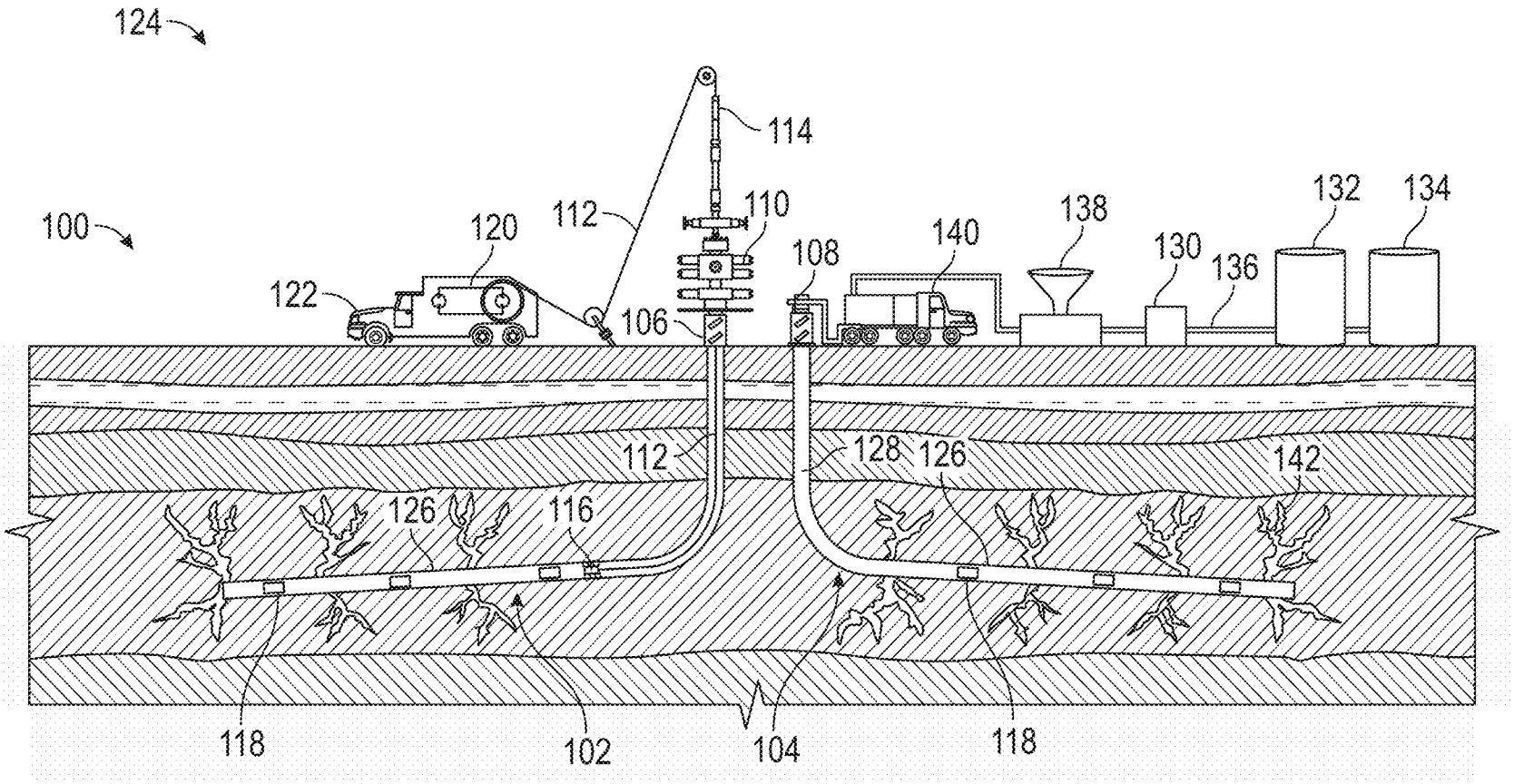
FIG. 8 shows an exemplary hydraulic fracturing site.

FIG. 8 shows a hydraulic fracturing site 100 undergoing a hydraulic fracturing operation in accordance with one or more embodiments. The particular hydraulic fracturing operation and hydraulic fracturing site 100 shown is for illustration purposes only. The scope of this disclosure is intended to encompass any type of hydraulic fracturing site 100 and hydraulic fracturing operation. In general, a hydraulic fracturing operation includes two separate operations: a perforation operation and a pumping operation.

In further embodiments, a hydraulic fracturing operation is performed in stages and on multiple wells that are geographically grouped. A singular well may have anywhere from one to more than forty stages. In one or more embodiments, each stage has a duration of 2-3 hours, such that the entire hydraulic fracturing operation may last several days.

Typically, each stage includes one perforation operation and one pumping operation. While one operation is occurring on one well, a second operation may be performed on the other well. As such, FIG. 8 shows a hydraulic fracturing operation occurring on a first well 102 and a second well 104. The first well 102 is undergoing the perforation operation and the second well 104 is undergoing the pumping operation.

The first well 102 and the second well 104 are horizontal wells meaning that each well includes a vertical section and a lateral section. The lateral section is a section of the well that is drilled at least eighty degrees from vertical. The first well 102 is capped by a first frac tree 106 and the second well 104 is capped by a second frac tree 108. A frac tree 106, 108 is similar to a Christmas/production tree but is specifically installed for the hydraulic fracturing operation. Frac trees 106, 108 tend to have larger bores and higher-pressure ratings than a Christmas/production tree would have. Further, hydraulic fracturing operations require abrasive materials being pumped into the well at high pressures, so the frac tree 106, 108 is designed to handle a higher rate of erosion.

In accordance with one or more embodiments, the first well 102 and the second well 104 each require four stages. Both the first well 102 and the second well 104 have undergone three stages and are undergoing the fourth stage. The second well 104 has already undergone the fourth stage perforation operation and is currently undergoing the fourth stage pumping operation. The first well 102 is undergoing the fourth stage perforating operation and has yet to undergo the fourth stage pumping operation.

In accordance with one or more embodiments, the perforating operation includes installing a wireline blow out preventor (BOP) 110 onto the first frac tree 106. A wireline BOP 110 is similar to a drilling BOP; however, a wireline BOP 110 has seals designed to close around (or shear) wireline 112 rather than drill pipe. A lubricator 114 is connected to the opposite end of the wireline BOP 110. A lubricator 114 is a long, high-pressure pipe used to equalize between downhole pressure and atmosphere pressure in order to run downhole tools, such as a perforating gun 116, into the well.

The perforating gun 116 is pumped into the first well 102 using the lubricator 114, wireline 112, and fluid pressure. In accordance with one or more embodiments, the perforating gun 116 is equipped with explosives and a frac plug 118 prior to being deployed in the first well 102. The wireline 112 is connected to a spool 120 often located on a wireline truck 122. Electronics (not pictured) included in the wireline truck 122 are used to control the unspooling/spooling of the wireline 112 and are used to send and receive messages along the wireline 112. The electronics may also be connected, wired or wirelessly, to a monitoring system 124 that is used to monitor and control the various operations being performed on the hydraulic fracturing site 100.

When the perforating gun 116 reaches a predetermined depth, a message is sent along the wireline 112 to set the frac plug 118. After the frac plug 118 is set, another message is sent through the wireline 112 to detonate the explosives, as shown in FIG. 8. The explosives create perforations in the casing 126 and in the surrounding formation. There may be more than one set of explosives on a singular perforation gun 116, each detonated by a distinct message. Multiple sets of explosives are used to perforate different depths along the casing 126 for a singular stage. Further, the frac plug 118 may be set separately from the perforation operation without departing from the scope of the disclosure herein.

As explained above, FIG. 8 shows the second well 104 undergoing the pumping operation after the fourth stage perforating operation has already been performed and perforations are left behind in the casing 126 and the surrounding formation. A pumping operation includes pumping a frac fluid 128 into the perforations in order to propagate the perforations and create hydraulic fractures 142 in the surrounding formation. The frac fluid 128 often comprises a certain percentage of water, proppant, and chemicals.

FIG. 8 shows chemical storage containers 130, water storage containers 132, and proppant storage containers 134 located on the hydraulic fracturing site 100. Frac lines 136 and transport belts (not pictured) transport the chemicals, proppant, and water from the storage containers 130, 132, 134 into a frac blender 138. A plurality of sensors (not pictured) are located throughout this equipment to send signals to the monitoring system 124. The monitoring system 124 may be used to control the volume of water, chemicals, and proppant used in the pumping operation.

The frac blender 138 blends the water, chemicals, and proppant to become the frac fluid 128. The frac fluid 128 is transported to one or more frac pumps, often pump trucks 140, to be pumped through the second frac tree 108 into the second well 104. Each pump truck 140 includes a pump designed to pump the frac fluid 128 at a certain pressure. More than one pump truck 140 may be used at a time to increase the pressure of the frac fluid 128 being pumped into the second well 104. The frac fluid 128 is transported from the pump truck 140 to the second frac tree 108 using a plurality of frac lines 136.

Embodiments of the present disclosure may provide at least one of the following advantages. The discussed method for determining embedment may be repeated using different aqueous-based fracturing fluids in order to build a plurality of proppant-rock interaction models. Operators may then select the particular fracturing fluid which maximizes hydraulic fracture conductivity for use in field operations. Embodiments of the disclosed method may also be repeated with the same fracturing fluid, while changing one of a number of hydraulic fracturing parameters. Hydraulic fracturing parameters may include pumping rate, pumping schedule, and proppant type. Repeating the method while changing various fracturing parameters allows for optimization of fracturing parameters for implementation into field operations. Embodiments of the present disclosure may also be coupled with a reservoir simulator to assist in improving the reliability of well productivity predictions for after the hydraulic fracturing operations have been completed.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method of determining a permeability of a hydraulic fracture, comprising:

obtaining formation parameters and a plurality of formation samples;

dividing the plurality of formation samples into a first group and a second group;

measuring mechanical and hydraulic properties of the first group;

soaking the second group in a fracturing fluid for a plurality of time periods, wherein soaking the second group in the fracturing fluid further comprising soaking the second group in a plurality of different fracturing fluids;

measuring, after each soaking time period, the mechanical and hydraulic properties of the second group;

building, using a computer processor, a proppant-rock interaction model based, at least in part, on the mechanical and hydraulic properties of the first group and the second group; and determining, using the computer processor, the permeability of a hydraulic fracture based, at least in part, on the proppant-rock interaction model and the formation parameters.

2. The method of claim 1, further comprising:

determining a hydraulic fracture plan based, at least in part, on the proppant-rock interaction model; and performing a hydraulic fracture operation using a hydraulic fracturing system based, at least in part, on the hydraulic fracture plan.

3. The method of claim 1, wherein building the proppant-rock interaction model comprises determining a fracturing fluid penetration depth of a proppant with time after formation exposure to fracturing fluid.

4. The method of claim 1, wherein building the proppant-rock interaction model further comprises performing a contact mechanics simulation.

5. The method of claim 1, further comprising determining a fracture permeability for each fracturing fluid.

6. The method of claim 5, further comprising selecting a fracturing fluid that maximizes fracture permeability.

7. The method of claim 6, wherein a fracturing fluid that maximizes fracture permeability comprises an aqueous-based fracturing fluid.

8. The method of claim 1, wherein the mechanical and hydraulic properties are selected from a group consisting of a Young's modulus, a Poisson's ratio, a uniaxial compressive strength, a friction angle, a porosity, and a permeability.

9. The method of claim 1, wherein the formation parameters are selected from a group consisting of an in-situ stress, a pore pressure, and a drawdown pressure.

* * * * *